US005495898A

United States Patent [19]

McGugan

[11] Patent Number: 5,495,898

[45] Date of Patent: Mar. 5, 1996

[54] BLADE CONTROL SYSTEM FOR MOTOR GRADERS

[75] Inventor: Edward McGugan, Holyrood, Canada

[73] Assignee: Champion Road Machinery Limited, Ontario, Canada

[21] Appl. No.: 274,410

[22] Filed: Jul. 13, 1994

[51] Int. Cl.[6] ..... E02F 3/76

[52] U.S. Cl. ..... 172/780; 172/666; 172/789; 172/793

[58] Field of Search ..... 172/666, 292, 172/297, 745, 753, 780, 789, 793, 797; 37/380, 381, 417; 180/78, 79, 315, 307, 308; 403/52, 66, 72, 378, 379

[56] References Cited

U.S. PATENT DOCUMENTS

| | | | |
|---|---|---|---|
| 3,618,671 | 11/1971 | Chantland | 172/297 |
| 3,739,861 | 6/1973 | Johnson et al. | 172/793 |
| 3,986,563 | 10/1976 | Stubben | 172/793 |
| 4,071,091 | 1/1978 | Morris | 172/797 |
| 4,246,972 | 1/1981 | Halmosi et al. | 172/789 |
| 4,279,312 | 7/1981 | Pyle | 172/789 |
| 4,340,119 | 7/1982 | MacDonald | 172/789 |
| 4,637,751 | 1/1987 | Vollmer | 403/379 |

*Primary Examiner*—Terry Lee Melius
*Assistant Examiner*—Robert Pezzuto

[57] ABSTRACT

A highlift adjusting mechanism for the blade of a motor grader uses the traditional twin highlift cylinders connected to the motor grader by means of bell cranks. A rigid link member joins lower ends of the bell cranks and includes a number of locking ports therein. The link member is pivotally connected to the bell cranks by a specialized arrangement which additionally defines a further locking port. In the preferred form, the link member is secured to the bell cranks by pin members which include a cavity in one end thereof sized to receive the locking pin. With this arrangement, the bell cranks can be maintained closer to the frame of the grader and improved visibility is achieved.

6 Claims, 2 Drawing Sheets

BLADE CONTROL SYSTEM FOR MOTOR GRADERS

FIELD OF THE INVENTION

The present invention relates to highlifts for motor graders, and in particular relates to a highlift for a motor grader which uses opposed bell cranks which are pivotally connected to a rigid link member at the lower end thereof. The link member and the securement of the link member and to the bell cranks are adapted for a special cooperation with a locking pin arrangement.

BACKGROUND OF THE INVENTION

Highlifts for motor graders are well known and one particular design uses opposed bell cranks secured either side of a grader. U.S. Pat. No. 3,986,563 is an example of such a structure and this structure additionally discloses the use of locking ports in the bell cranks to define further locking positions.

Some designs of opposed bell crank highlift arrangement, some designs have sought to keep the arms well spaced from the main frame of the motor grader to allow viewing in the gap between the bell cranks and the main frame. With this approach, it has been possible to allow for a substantial rotation of the bell cranks and this makes the structure more suitable for ditching and banking to one side of the grader. The high degree of rotation, generally up to around 50°, allows the moldboard and the blade to be adjusted to extend to one side of the grader, generally outside of the wheels. In this way, the grader can perform a ditching or banking operation without actually riding on the bank or ditch. This is much safer, as there is generally a flat road bed or flat surface adjacent the ditch.

A slightly different arrangement is disclosed in U.S. Pat. No. 3,739,861 where the rotation of the highlift is more limited, however, the bell cranks of the highlift have been brought in closer to the frame of the grader. By bringing the bell cranks in closer to the grader frame, improved visibility exterior to the bell cranks is provided. This advantage is lost or acts as a disadvantage for ditching or banking operations which require a high degree of rotation.

Although some improved visibility between the bell cranks and the main frame is desirable, it is more preferable to maintain a nonobstructed area generally exterior to the bell cranks.

It is certainly desirable to maintain the bell cranks and related components as small as possible while still providing the necessary degree of rotation either side of the main frame. It is generally believed that a rotation of approximately 50° is satisfactory.

SUMMARY OF THE INVENTION

In a motor grader, having a main frame with a drawbar unit universally connected by a forward end thereof to the main frame, an improved highlift arrangement is disclosed. The motor grader includes a blade carrying moldboard secured to the end of the drawbar opposite the universal connection with the main frame. Two opposed bell cranks are pivotally secured either side of the main frame. One end of the bell crank rotatably supports a lift cylinder, with the other end of the bell crank being pivotally connected to a rigid linking member which joins the lower ends of the bell cranks. The linking member is pivotally secured to each bell crank. The rigid link member has a plurality of locking ports which cooperate with a locking pin secured generally beneath the grader frame. The locking pin serves to lock the rigid link member, and thus, lock the bell crank in various adjusted or locked positions determined by locking ports provided in the link member. One of the locking ports is defined within the pivotal connection of each bell crank to the rigid link. This is preferably the end locking port, and thus, serves a dual purpose.

In a preferred embodiment of the invention, the rigid link member is secured by a pin arrangement to each bell crank and the pin associated with each bell crank has a cavity therein for receiving and locking with the lock pin.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
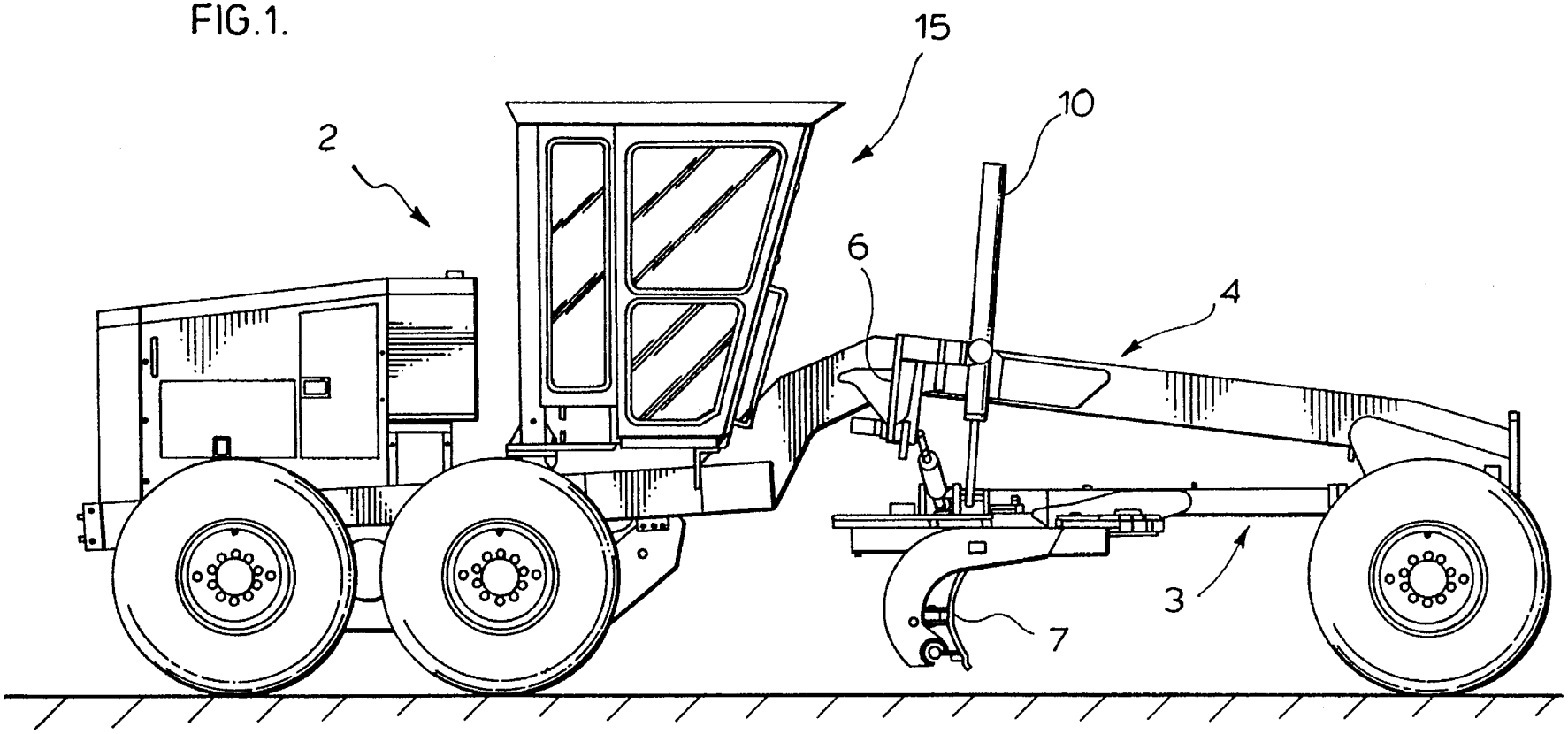
FIG. 1 is a side perspective view of a motor grader.

As shown in FIG. 1, the motor grader 2 has a main frame 4. A drawbar 3 is connected to the main frame 4 at a universal connection, generally at the front of the main frame. The drawbar at the distal end thereof secures a moldboard to which the blade 7 is secured. Two opposed bell cranks 6 and 8 are secured either side of the main frame 4 and pivotally secure at outer arms of the bell crank lift cylinders 10 and 12. The lower ends of the lift cylinders are pivotally secured to the blade carrying moldboard. The operator sits in the cab 15 and views forwardly through the highlift and to either side of the frame 4.

Figure 3:
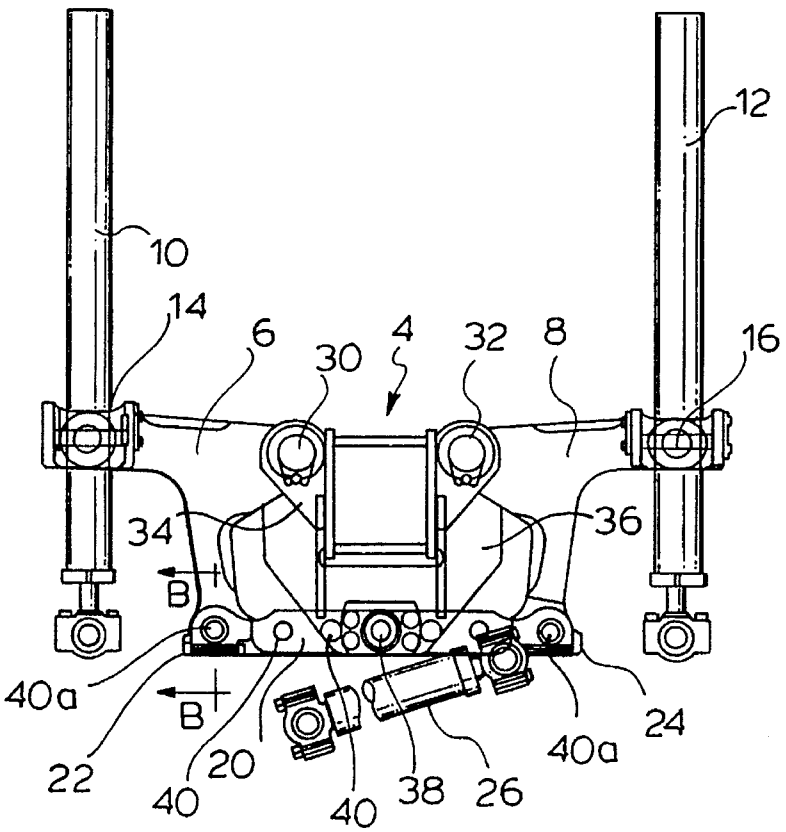
FIG. 3 is a front sectional view through the frame showing the highlift adjustment mechanism.
Figure 2:
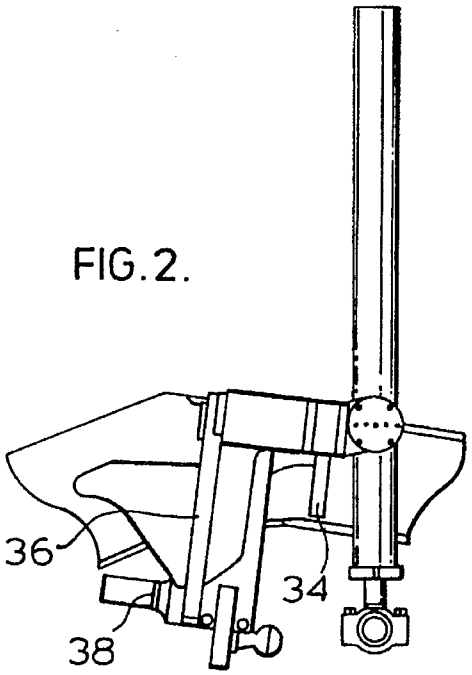
FIG. 2 is a partial side elevation of components of the highlift arrangement secured on the motor grader frame.

The lower arms of the bell cranks are pivotally connected at 22 to a rigid link member 20 having a plurality of locking ports 40 therein (see FIGS. 2 and 3).

A locking pin 38 is secured beneath the main frame 4 and is fixed below the main frame. The bell cranks 6 and 8 are pivotally secured to a front support plate 34 and the rear support plate 36. The rear support plate 36 also supports the locking pin 38.

Figure 4:
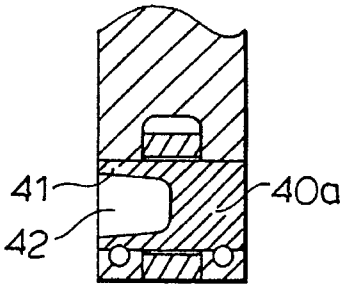
FIG. 4 is a sectional view along line B—B of FIG. 3.

The pivot connections 22 and 24 of the rigid link member 20 to the bell cranks 6 and 8 also serve as locking ports 40A. As shown in FIG. 4, 40A is a securing pin having a locking cavity 42 in one end thereof, which is engageable with the locking pin 38. In this way, the securing pin 40A serves both as the mechanical connection of the rigid link to the bell cranks as well as a locking port. Note, that the securing pin 40A adjacent the cavity 42 still includes structural wall 41 sufficient to cooperate with the rest of the securing pin to provide a strong pivotting mechanical connection between the rigid link and one of the bellcranks.

It is has been found desirable that the bell cranks should allow approximately a 50° rotation of each bell crank to either side of the motor grader. This allows the blade carrying mold board to be positioned offset from the main axis of the motor grader. In this position, the blade can be positioned for ditching beyond the wheels of the motor grader and/or banking beyond the wheels of the motor grader. It is highly desirable to achieve either this negative sloping or positive sloping beyond the wheels of the grader, as the grader can be maintained on a generally flat or horizontal surface and perform an angled banking or ditching operation. The spacing between the opposed lift cylinders is approximately 62 inches.

Some arrangements do not allow a full 50° rotation, and thus, have some deficiencies with respect to the ease with which they perform the banking and ditching operations. It is also important to provide as much visibility adjacent the highlift arrangement, as the operator must be able to see the position of the blade relative to the front wheels of the motor grader as well as to the side of the highlift. This improved visibility is possible, as the bell cranks are maintained as close to the frame of the grader as possible, and also, the rigid link member 20 is maintained as close as possible beneath the underside of the main frame. As can be seen, the lower arms of the bell cranks are substantially below the main frame as well as the rigid link; however, this is in the neutral position of the highlift. As the highlift assembly is rotated to one side, it can be appreciated that the lower end of one bell crank is raised while, at least initially, the lower end of the other bell crank is lowered. Therefore, some clearance of the rigid link member below the main frame is required. In addition to maintaining the bell cranks as close to the main frame as possible, in particular maintaining the lower arms of the bell cranks close to the main frame, where possible, it is desirable to allow visibility between the bell cranks and the main frame. Although this is obstructed and somewhat a limited viewing area, it does provide some benefits. The main advantage is to maintain the area exterior to the bell cranks as unobstructed as possible.

It has been found with this arrangement that a very satisfactory adjustment of the blade is possible, while providing improved visibility. It must be appreciated that the operator is generally centered behind the highlift and looks down to the ground to observe the blade position generally through the highlift or to one side thereof. Therefore, maintaining the lower arms of the bell cranks close to the frame is desirable. It has been found by using the point of securement of the pin connection of the rigid link to the bell cranks as an additional locking port that the size of these components can be somewhat reduced while still achieving the same rotation. Therefore, this reduction in size improves visibility and is thus more desirable.

Although various preferred embodiments of the present invention have been described herein in detail, it will be appreciated by those skilled in the art, that variations may be made thereto without departing from the spirit of the invention or the scope of the appended claims.

THE EMBODIMENTS OF THE INVENTION IN WHICH AN EXCLUSIVE PROPERTY OR PRIVILEGE IS CLAIMED ARE DEFINED AS FOLLOWS:

1. In a motor grader having a main frame with a drawbar universally connected at a forward end thereof to the main frame, a blade carrying moldboard secured to the end of said drawbar remote the universal connection with said main frame, two opposed bell cranks each pivotally secured at a position intermediate the bellcrank at one side of the main frame, lift cylinders located either side of the grader frame with a lower end of each cylinder connected to blade carrying moldboard, each bell crank at an upper distal end supporting a lift cylinder with a lower distal end of each bellcrank having a pivotal connection between the bell crank and a rigid link member connecting said bellcranks such that movement of one bell crank causes predetermined movement of the other bell crank, said link member having a plurality of locking ports which cooperate with a locking pin secured to said grader frame to lock said rigid link member and said bellcranks in various locked positions determined by said locking ports, and at least one of said locking ports being located within one of the pivotal connections of said bellcranks to said rigid link.

2. In a motor grader as claimed in claim 1 wherein said rigid link member is secured to each bellcrank by securing pin having a cavity therein positioned for receiving said lock pin.

3. In a motor grader as claimed in claim 2 wherein said securing pin has tapered recess in one end thereof for receiving said lock pin.

4. In a motor grader as claimed in claim 1 wherein said link member and said bellcranks cooperate to define a generally flush surface which moves past said locking pin during adjustment of said link to any of said locking ports.

5. In a motor grader as claimed in claim 1 wherein each bellcrank is movable through an angle of approximately 50° rotation when said highlift is moved between locking ports located in said pivotal connections.

6. In a motor grader as claimed in claim 5 wherein said lift cylinders are separated approximately 62 inches at the pivot connection with said bellcranks.

* * * * *